US011041352B2

(12) United States Patent
Ferguson et al.

(10) Patent No.: US 11,041,352 B2
(45) Date of Patent: Jun. 22, 2021

(54) ADVANCEMENT OF A TUBULAR STRING INTO A WELLBORE

(71) Applicant: THRU TUBING SOLUTIONS, INC., Oklahoma City, OK (US)

(72) Inventors: Andrew M. Ferguson, Moore, OK (US); Brock W. Watson, Sadler, TX (US); Roger L. Schultz, Newcastle, OK (US)

(73) Assignee: Thru Tubing Solutions, Inc., Newcastle, OK (US)

( * ) Notice: Subject to any disclaimer, the term of this patent is extended or adjusted under 35 U.S.C. 154(b) by 997 days.

(21) Appl. No.: 15/159,435

(22) Filed: May 19, 2016

(65) Prior Publication Data

US 2016/0340994 A1 Nov. 24, 2016

Related U.S. Application Data

(60) Provisional application No. 62/164,786, filed on May 21, 2015.

(51) Int. Cl.
*E21B 28/00* (2006.01)
*E21B 23/14* (2006.01)
(Continued)

(52) U.S. Cl.
CPC ..... *E21B 28/00* (2013.01); *E21B 23/14* (2013.01); *E21B 23/00* (2013.01); *E21B 33/12* (2013.01)

(58) Field of Classification Search
CPC . E21B 4/18; E21B 23/00; E21B 33/12; E21B 33/1204; E21B 33/128;
(Continued)

(56) References Cited

U.S. PATENT DOCUMENTS 3,003,560 A 10/1961 Corley, Jr. et al.
3,070,167 A 12/1962 Loy, III et al.
(Continued)

FOREIGN PATENT DOCUMENTS

WO 2014150058 A1 9/2014

OTHER PUBLICATIONS

International Search Report with Written Opinion dated Sep. 1, 2016 for PCT Patent Application No. PCT/US2016/033269, 17 pages.

*Primary Examiner* — Robert E Fuller
*Assistant Examiner* — Lamia Quaim
(74) *Attorney, Agent, or Firm* — Smith IP Services, P.C.

(57) ABSTRACT

A system can include an annular restrictor connected in a tubular string. The annular restrictor restricts flow through an annulus formed between the tubular string and a wellbore. Restriction to the flow through the annulus biases the tubular string into the wellbore, and fluid in the wellbore displaces into the tubular string and/or a formation penetrated by the wellbore. A method can include connecting an annular restrictor in a tubular string, and flowing a fluid through an annulus formed between the tubular string and a wellbore, thereby causing a differential pressure across the annular restrictor, the differential pressure biasing the tubular string into the wellbore. Another method can include connecting an annular restrictor in a tubular string, flowing a fluid through an annulus, thereby biasing the tubular string into a wellbore, and then causing the annular restrictor to no longer restrict flow through the annulus.

21 Claims, 16 Drawing Sheets

(51) Int. Cl.
*E21B 33/12* (2006.01)
*E21B 23/00* (2006.01)

(58) Field of Classification Search
CPC ..... E21B 33/1208; E21B 33/1285; E21B 33/129; E21B 33/1291; E21B 33/1292; E21B 33/1293; E21B 33/134
See application file for complete search history.

(56) References Cited

U.S. PATENT DOCUMENTS 3,126,058 A 3/1964 Yetman et al.
3,467,196 A 9/1969 Kinsman
3,554,279 A * 1/1971 Meripol ..... E21B 23/06 166/121
3,656,562 A * 4/1972 Baugh ..... E21B 23/02 166/55.1
RE32,755 E * 9/1988 Vann ..... E21B 33/12 166/250.07
5,180,009 A 1/1993 Sneed
5,209,304 A 5/1993 Nice
5,967,816 A 10/1999 Sampa et al.
6,315,498 B1 11/2001 Baugh et al.
6,343,657 B1 2/2002 Baugh et al.
6,491,098 B1 * 12/2002 Dallas ..... E21B 43/116 166/297
6,651,744 B1 11/2003 Crawford
7,279,052 B2 10/2007 Kinnari et al.
8,844,636 B2 9/2014 Bebak et al.
2002/0144812 A1 10/2002 Smith, Jr.
2003/0047320 A1 * 3/2003 Badrak ..... E21B 23/00 166/380
2004/0118565 A1 * 6/2004 Crawford ..... E21B 4/18 166/312
2005/0284504 A1 * 12/2005 Kinnari ..... F16L 55/38 134/22.11
2005/0284624 A1 12/2005 Libby et al.
2012/0247756 A1 10/2012 Taylor
2014/0116724 A1 5/2014 McDougall et al.
2014/0158369 A1 6/2014 Radford et al.
2014/0190685 A1 * 7/2014 Frazier ..... E21B 33/1208 166/250.01
2015/0176363 A1 * 6/2015 Mazyar ..... E21B 33/12 166/179
2017/0067313 A1 * 3/2017 Connell ..... E21B 33/124
2018/0230364 A1 * 8/2018 Weaver ..... C09K 8/805

* cited by examiner

ADVANCEMENT OF A TUBULAR STRING INTO A WELLBORE

CROSS-REFERENCE TO RELATED APPLICATION

This application claims the benefit of the filing date of U.S. provisional application No. 62/164,786 filed on 21 May 2015. The entire disclosure of this prior application is incorporated herein by this reference.

BACKGROUND

This disclosure relates generally to equipment utilized and operations performed in conjunction with a subterranean well and, in an example described below, more particularly provides for advancement of a tubular string into a wellbore.

It can sometimes be difficult to convey a tubular string with a bottom hole assembly into a wellbore. For example, if a wellbore section is horizontal or substantially inclined, friction between the tubular string and the wellbore section can prevent further displacement of the tubular string into the wellbore, even if a weight of the tubular string in a vertical section of the wellbore acts to bias the tubular string into the wellbore. Therefore, it will be appreciated that advancements are continually needed in the art of conveying tubular strings and bottom hole assemblies into wellbores. Such advancements may be useful, regardless of whether the tubular strings and bottom hole assemblies are positioned in horizontal wellbore sections.

DETAILED DESCRIPTION

Figure 1:
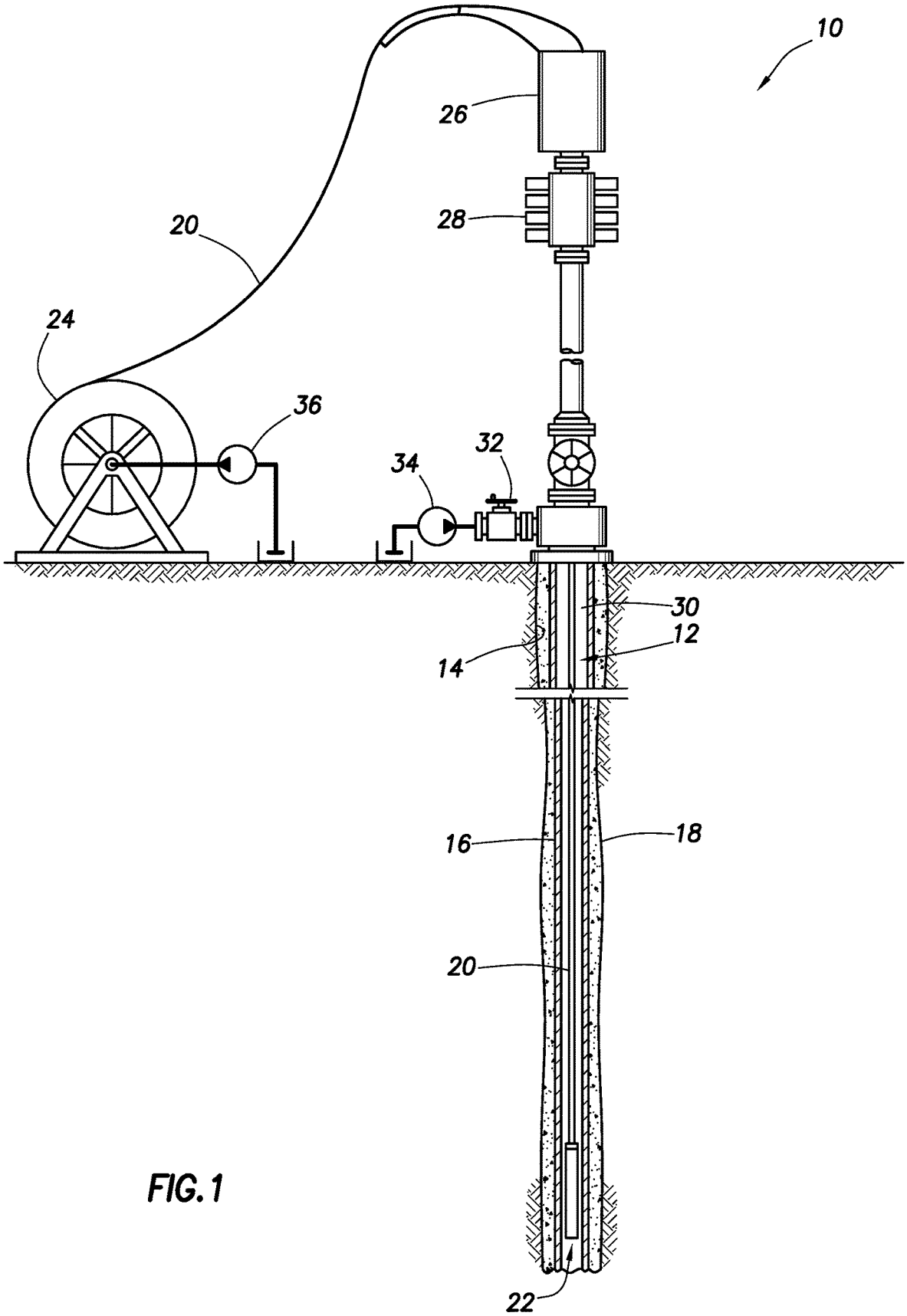
FIG. 1 is a representative partially cross-sectional view of an example of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is conveyed into a wellbore 14 lined with casing 16 and cement 18. Although multiple casing strings would typically be used in actual practice, for clarity of illustration only one casing string 16 is depicted in the drawings.

Although the wellbore 14 is illustrated as being vertical, sections of the wellbore could instead be horizontal or otherwise inclined relative to vertical. Although the wellbore 14 is completely cased and cemented as depicted in FIG. 1, any sections of the wellbore in which operations described in more detail below are performed could be uncased or open hole. Thus, the scope of this disclosure is not limited to any particular details of the system 10 and method.

The tubular string 12 of FIG. 1 comprises coiled tubing 20 and a bottom hole assembly 22. As used herein, the term "coiled tubing" refers to a substantially continuous tubing that is stored on a spool or reel 24. The reel 24 could be mounted, for example, on a skid, a trailer, a floating vessel, a vehicle, etc., for transport to a wellsite. Although not shown in FIG. 1, a control room or cab would typically be provided with instrumentation, computers, controllers, recorders, etc., for controlling equipment such as an injector 26 and a blowout preventer stack 28.

As used herein, the term "bottom hole assembly" refers to an assembly connected at or near a distal end of a tubular string in a well. It is not necessary for a bottom hole assembly to be positioned or used at a "bottom" of a hole or well.

When the tubular string 12 is positioned in the wellbore 14, an annulus 30 is formed radially between them. Fluid, slurries, etc., can be flowed from surface into the annulus 30 via, for example, a casing valve 32. One or more pumps 34 may be used for this purpose. Fluid can also be flowed to surface from the wellbore 14 via the annulus 30 and valve 32.

Fluid, slurries, etc., can also be flowed from surface into the wellbore 14 via the tubing 20, for example, using one or more pumps 36. Fluid can also be flowed to surface from the wellbore 14 via the tubing 20.

Figure 2:
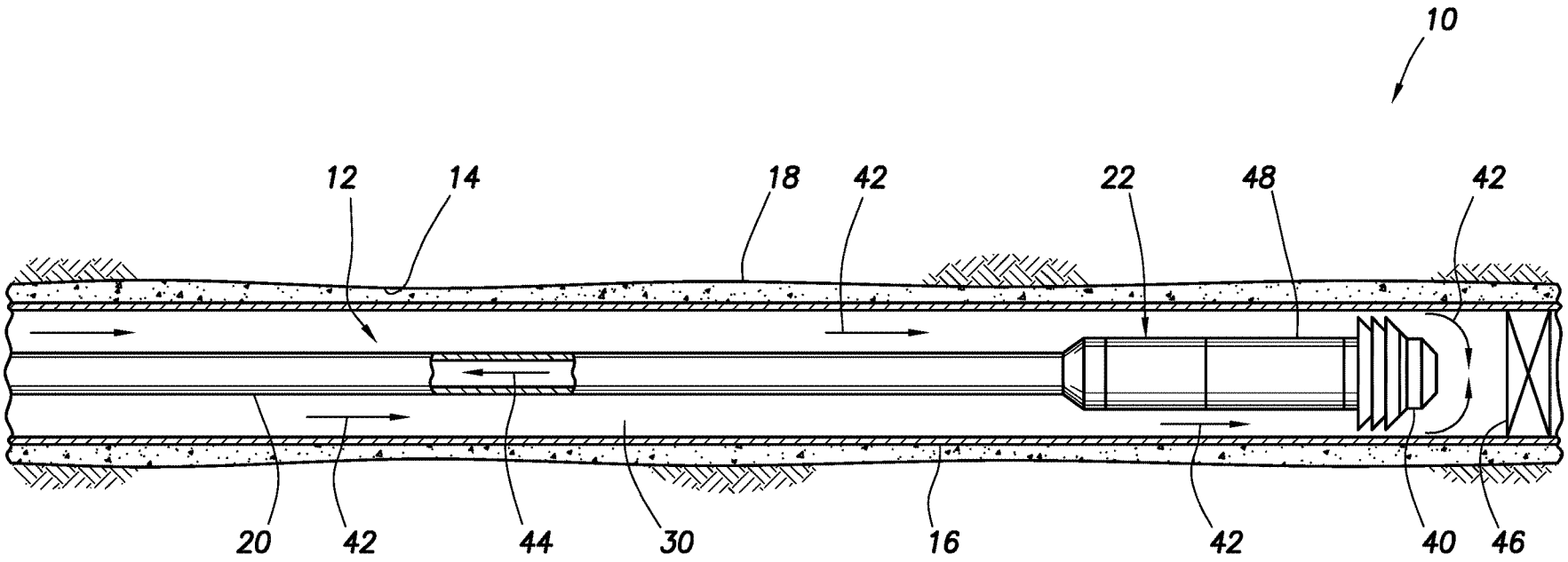
FIG. 2 is an enlarged scale representative partially cross-sectional view of an example of a bottom hole assembly being conveyed into a wellbore utilizing the principles of this disclosure.

Referring additionally now to FIG. 2, an enlarged scale cross-sectional view of one example of the bottom hole assembly 22 is representatively illustrated in a generally horizontal section of the wellbore 14. The bottom hole assembly 22 example of FIG. 2 may be used with the system 10 and method of FIG. 1, or it may be used with other systems and methods.

In the FIG. 2 example, the bottom hole assembly 22 includes an annular restrictor 40. The annular restrictor 40 is connected at a distal end of the bottom hole assembly 22 in the FIG. 2 example, but in other examples the annular restrictor could be otherwise positioned or separate from the bottom hole assembly (such as, connected in the tubular string 12 above the bottom hole assembly).

The annular restrictor 40 restricts flow of fluid 42 through the annulus 30. The fluid 42 may be pumped through the annulus 30 from the earth's surface, for example, using the pump 34 of FIG. 1. However, other means of pressurizing or displacing the fluid 42 through the annulus 30 may be used, if desired.

The annular restrictor 40 in the FIG. 2 example does not completely prevent flow through the annulus 30 at the annular restrictor (that is, the annular restrictor does not completely seal off the annulus between the tubular string 12 and an inner surface of the casing 16). Instead, there is some leakage of the fluid 42 past the annular restrictor 40. However, in other examples, the annular restrictor 40 could completely seal off the annulus 30, if desired.

Although the annular restrictor 40 does not completely seal off the annulus 30 in the FIG. 2 example, it does restrict flow of the fluid 42 through the annulus sufficiently to create a pressure differential across the annular restrictor. In this manner, the annular restrictor 40 is similar to a piston, and the differential pressure across the annular restrictor results in a biasing force being applied to the bottom hole assembly 22. This biasing force acts to displace the bottom hole assembly 22 further into the wellbore 14.

In order for the differential pressure to be created across the annular restrictor 40, fluid 44 in the casing 16 below the annular restrictor should be able to displace (e.g., so that the fluid is not significantly compressed in the casing below the annular restrictor, as the annular restrictor advances through the casing). In some examples, the casing 16 may be perforated below the bottom hole assembly 22, thereby allowing the fluid 44 to exit the casing via perforations.

However, in the FIG. 2 example, a plug 46 seals off the casing 16 so that, even if the casing is perforated below the plug, the fluid 44 cannot displace out of the casing via the perforations. Instead, the fluid 44 is allowed to flow into and through the bottom hole assembly 22 and coiled tubing 20 of the tubular string 12. The fluid 44 may flow to the surface via the tubular string 12.

Note that the fluid 44 can comprise the fluid 42 and any fluid in the wellbore 14 displaced by the bottom hole assembly 22 as it advances into the wellbore. If the annular restrictor 40 completely seals off the annulus 30, then the fluid 44 may not include any of the fluid 42, but may only include the fluid in the wellbore 14 displaced by the bottom hole assembly 22 as it advances into the wellbore.

In the FIG. 2 example, the bottom hole assembly 22 also includes a vibratory tool 48 that generates vibrations in response to flow of the fluid 44 through the tool. These vibrations can assist in displacing the bottom hole assembly 22 through the wellbore 14, especially if the bottom hole assembly is positioned in a horizontal or substantially inclined wellbore section. However, it is not necessary for the bottom hole assembly 22 to include the vibratory tool 48, or for the bottom hole assembly to include any particular tool(s) or combination of tools.

At an appropriate time, the annular restrictor 40 can be released from the tubular string 12, if desired. For example, the annular restrictor 40 may be released prior to retrieving the tubular string 12 from the well. In this manner, the annular restrictor 40 will not hinder retrieval of the tubular string 12, and will not "swab" the well (e.g., create a significant pressure reduction below the annular restrictor) as the tubular string is retrieved.

Figure 3:
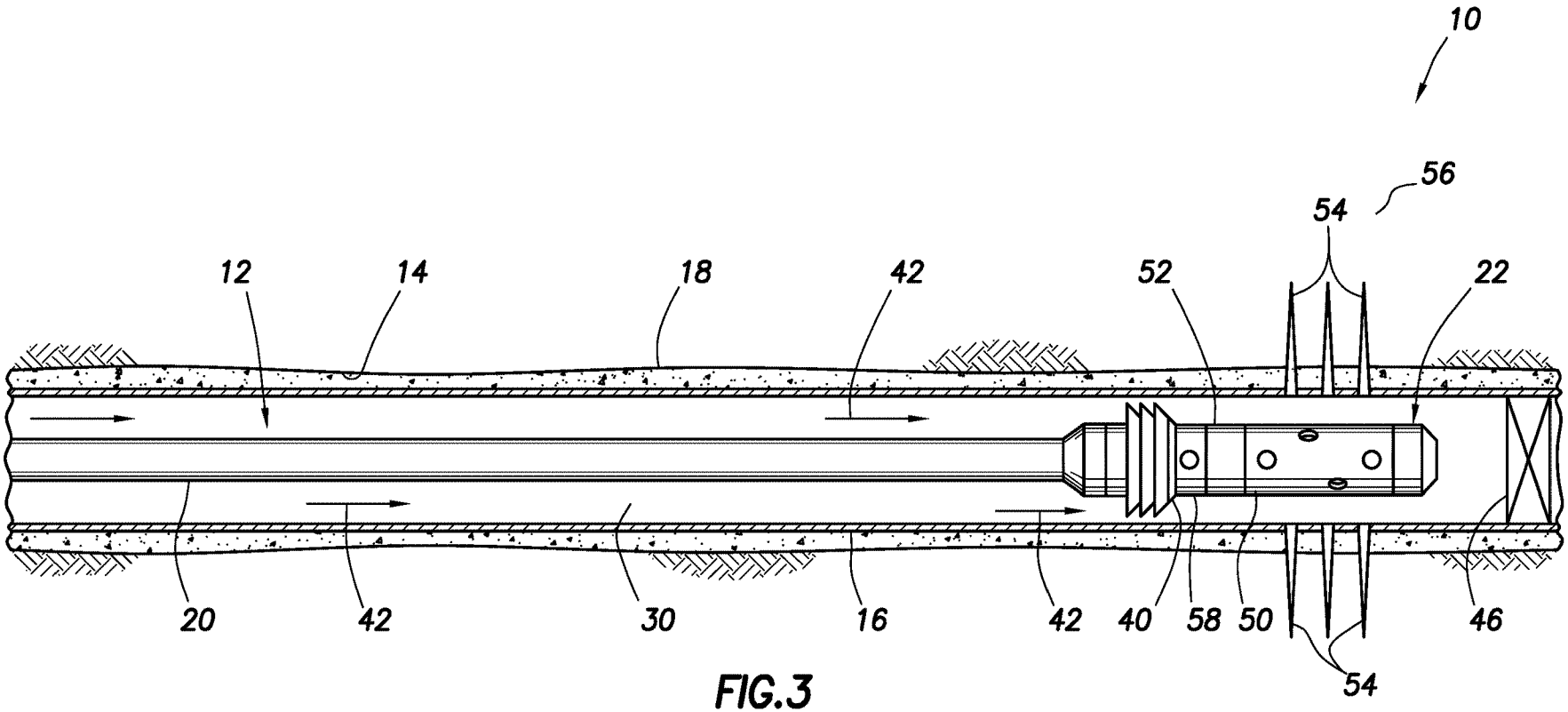
FIG. 3 is a representative partially cross-sectional view of another example of the bottom hole assembly, in which the bottom hole assembly includes a perforator.

Referring additionally now to FIG. 3, another example of the bottom hole assembly 22 is representatively illustrated. In this example, the bottom hole assembly 22 includes a perforator 50 and a firing head 52. The perforator 50 and firing head 52 are connected below the annular restrictor 40, but in other examples the annular restrictor could be connected below the perforator and firing head.

The perforator 50 is used to form perforations 54 through the casing 16 and cement 18, and into an earth formation 56 penetrated by the wellbore 14. The firing head 52 is used to fire the perforator 50 which, in this example, may include explosive shaped charges to form the perforations 54. The firing head 52 may fire the perforator 50 in response to any of various stimuli, such as, pressure pulses, flow manipulations, time or temperature levels, electromagnetic signals, acoustic signals, etc.

However, other types of perforators may be used in other examples. An abrasive jet perforator may be used, in which case the firing head 52 would not be necessary.

The pressure differential across the annular restrictor 40 due to the flow of the fluid 42 through the annulus 30 may be used to convey the perforator 50 to a desired position for forming the perforations 54. The perforations 54 can then be formed by activating the firing head 52 to fire the perforator 50. After the perforations 54 are formed, the annular restrictor 40, firing head 52 and perforator 50 can be released from the tubular string 12, and the tubular string can be retrieved from the well, if desired.

Note that, after the perforations 54 are formed, fluid in the casing 16 below the annular restrictor 40 can be displaced into the formation 56 via the perforations. Thus, if the annular restrictor 40 is positioned sufficiently far above the perforator 50 (or multiple perforators), the pressure differential across the annular restrictor can be used to convey the perforator(s) to multiple locations for forming perforations. For example, multiple zones could be perforated in a single trip of the tubular string 12 into the well.

Prior to forming the perforations 54, any of the fluid 42 that flows past the annular restrictor 40, and fluid in the casing 16 below the annular restrictor, can flow to the surface via the tubular string 12. For example, a valve or ported sub 58 may be used to allow fluid flow into the tubular string 12 below the annular restrictor 40.

Figure 4:
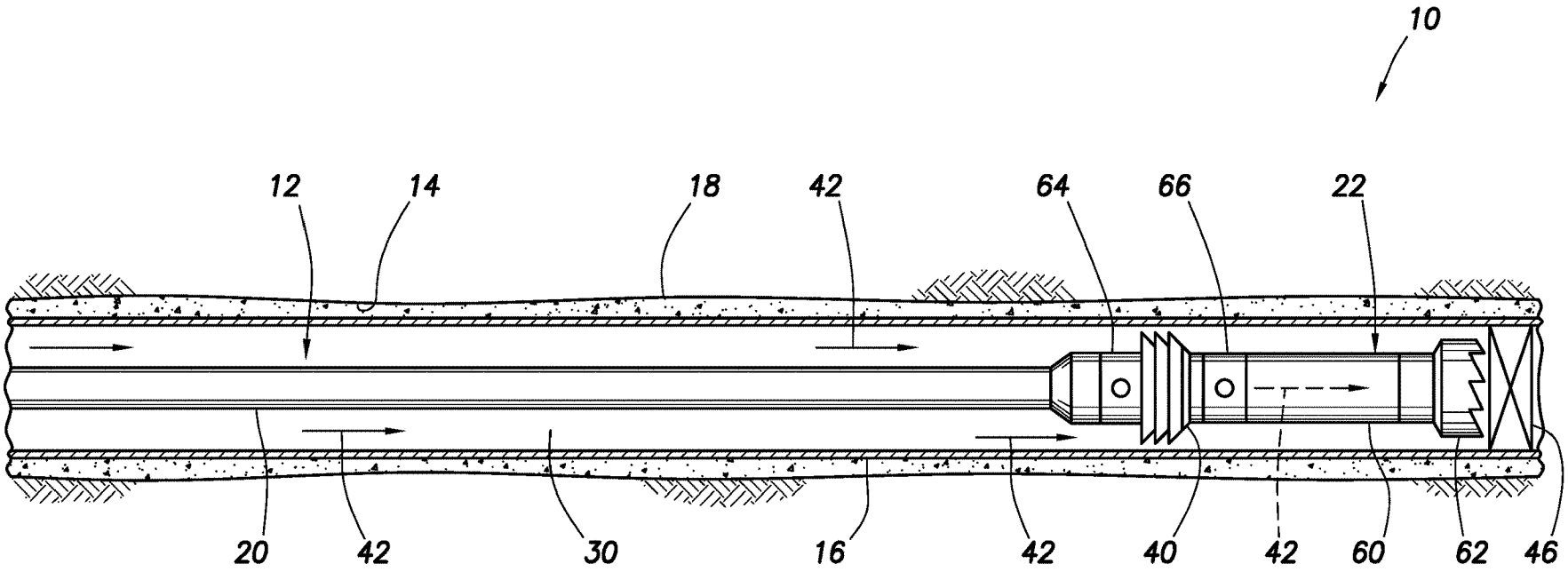
FIG. 4 is a representative partially cross-sectional view of another example of the bottom hole assembly, in which the bottom hole assembly includes a cutting device.

Referring additionally now to FIG. 4, another example of the bottom hole assembly 22 is representatively illustrated. In this example, the bottom hole assembly 22 includes a fluid motor 60 and a cutting device 62.

The fluid motor 60 operates in response to flow of the fluid 42 through the motor. The fluid motor 60 may be a turbine-type drilling or milling motor. Alternatively, the fluid motor 60 may be a Moineau-type progressive cavity drilling or milling motor. Any type of fluid motor may be used in keeping with the scope of this disclosure.

The cutting device 62 is rotated by the fluid motor 60. The cutting device 62 may be a mill used, for example, to cut through the plug 46 or the casing 16 (e.g., to form a window for drilling a lateral or branch wellbore). Alternatively, the cutting device 62 may be a drill bit used to elongate the wellbore 14. Any type of cutting device may be used in keeping with the scope of this disclosure.

A valve or ported sub 64 may be used to allow the fluid 42 to flow from the annulus 30 above the annular restrictor 40, into the bottom hole assembly 22, and through the fluid motor 60. Another valve or ported sub 66 may be used to allow the fluid 42 that exits the cutting device 62 (as well as any fluid in the casing 16 below the annular restrictor 40) to flow into the bottom hole assembly 22 below the annular restrictor 40, for return to the surface via the tubular string 12.

After the plug 46 has been milled through (or after drilling or other cutting operations are concluded), the annular restrictor 40 can be released from the tubular string 12. The tubular string 12 can then be retrieved from the well.

In some examples, the annular restrictor 40 could be made of a dispersible or degradable material, so that the annular restrictor no longer substantially restricts flow through the annulus 30. Thus, instead of releasing the annular restrictor 40 from the tubular string 12, the annular restrictor could be dissolved (e.g., by flowing a particular fluid, such as acid, into contact with the annular restrictor) or otherwise degraded or dispersed, prior to retrieving the tubular string.

However, in some examples the tubular string 12 may not be retrieved from the well (e.g., in certain completion or workover operations). Thus, the scope of this disclosure is not limited to releasing, dissolving, degrading or dispersing the annular restrictor 40 prior to retrieving the tubular string 12.

The force generated by the pressure differential across the annular restrictor 40 may result in an immediate displacement of the bottom hole assembly 22, or the force may be "stored" for later use. In the FIG. 4 example, a compressible biasing device (such as, a compression spring, a pressurized gas chamber, a resilient member, etc.) could be connected between the annular restrictor 40 and the cutting device 62, so that the force generated by flow of the fluid 42 through the annulus 30 is stored in the biasing device. The stored force can then be used to continually bias the cutting device 62 into contact with the plug 46 (or other structure being cut) while the fluid motor 60 rotates the cutting device.

Referring additionally now to FIGS. 5A-F, another example of the bottom hole assembly 22 is representatively illustrated in successive axial sections. The bottom hole assembly 22 in this example is similar in some respects to the example of FIG. 3, in that it includes an annular restrictor 40 and a perforator 50. However, the annular restrictor 40 and perforator 50 are differently configured in the FIGS. 5A-F example.

The annular restrictor 40 is connected below the perforator 50 in the FIGS. 5A-F example. In addition, the annular restrictor 40 is capable of sealingly engaging the interior surface of the casing 16 and completely preventing flow of the fluid 42 past the annular restrictor, thereby sealing off the annulus 30 in the system 10. However, the FIGS. 5A-F bottom hole assembly 22 may be used with other systems and methods, and it is not necessary for the annular restrictor 40 of the FIGS. 5A-F bottom hole assembly to completely seal off an annulus, in keeping with the scope of this disclosure.

The perforator 50 in the FIGS. 5A-F example is an abrasive jet perforator, instead of an explosive shaped charge perforator. However, any type of perforator may be used in the FIGS. 5A-F bottom hole assembly 22, in keeping with the scope of this disclosure.

Figure 5A:
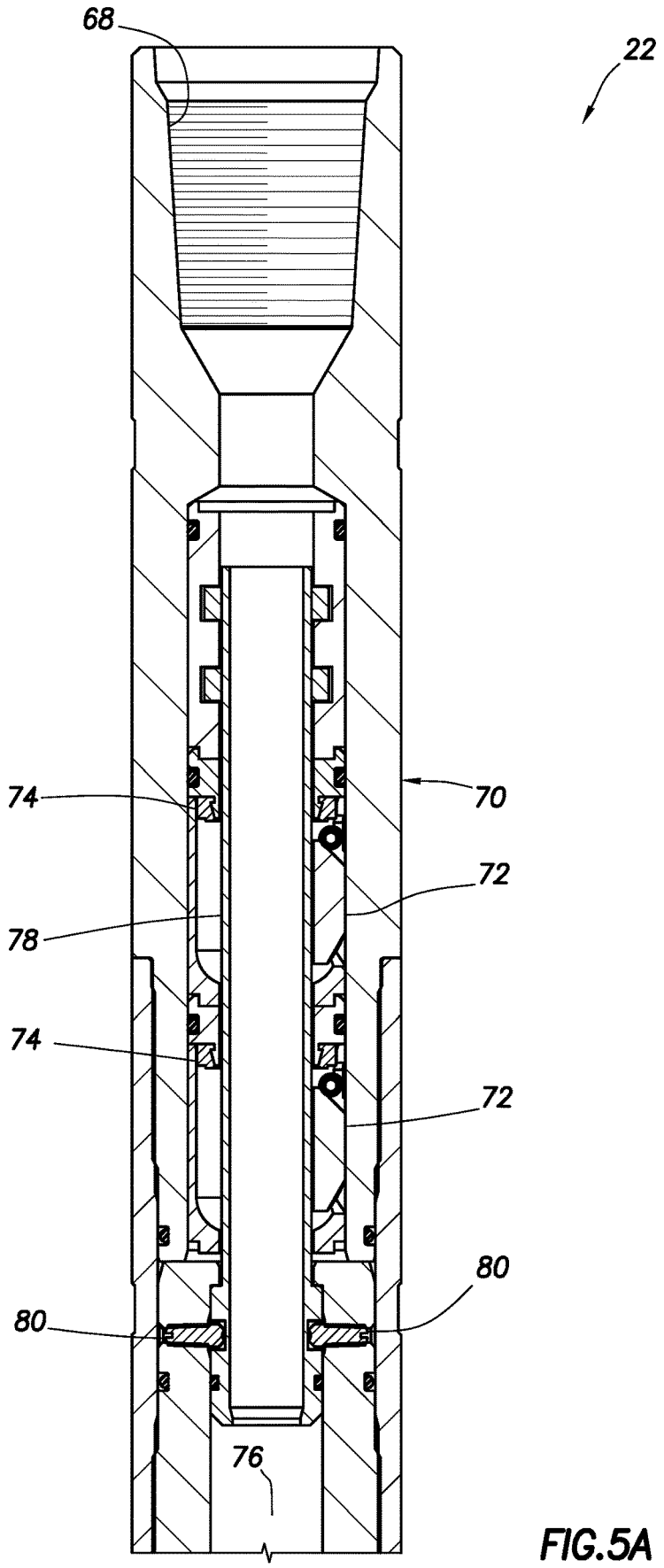
FIGS. 5A-F are further enlarged scale representative cross-sectional views of successive axial sections of another example of a bottom hole assembly that can incorporate the principles of this disclosure.

Beginning with FIG. 5A, it may be seen that the bottom hole assembly 22 includes an upper connector 68 for connecting the bottom hole assembly to the tubing 20. A separate tubing connector (not shown) may also be used, if desired.

A back pressure valve 70 is positioned below the upper connector 68. The back pressure valve 70 in this example includes two pivotably mounted flappers 72 that are biased toward sealing engagement with annular seats 74 encircling a central longitudinal flow passage 76.

However, a sleeve 78 positioned in the passage 76 prevents the flappers 72 from rotating toward the seats 74. Shear members 80 releasably retain the sleeve 78 in this position.

Figure 5B:
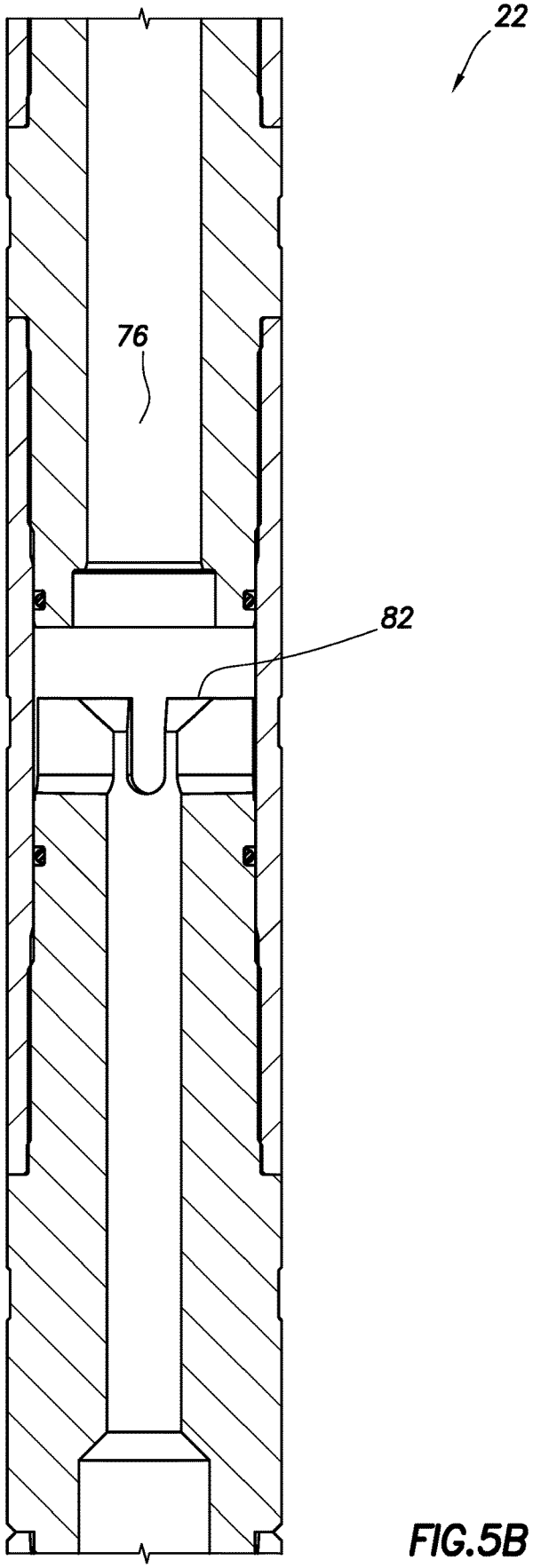

In FIG. 5B, it may be seen that a castellated support 82 is provided for the sleeve 78. When the sleeve 78 displaces downward (as described more fully below), the castellated support 82 allows flow through the passage 76 around a lower end of the sleeve.

Figure 5C:
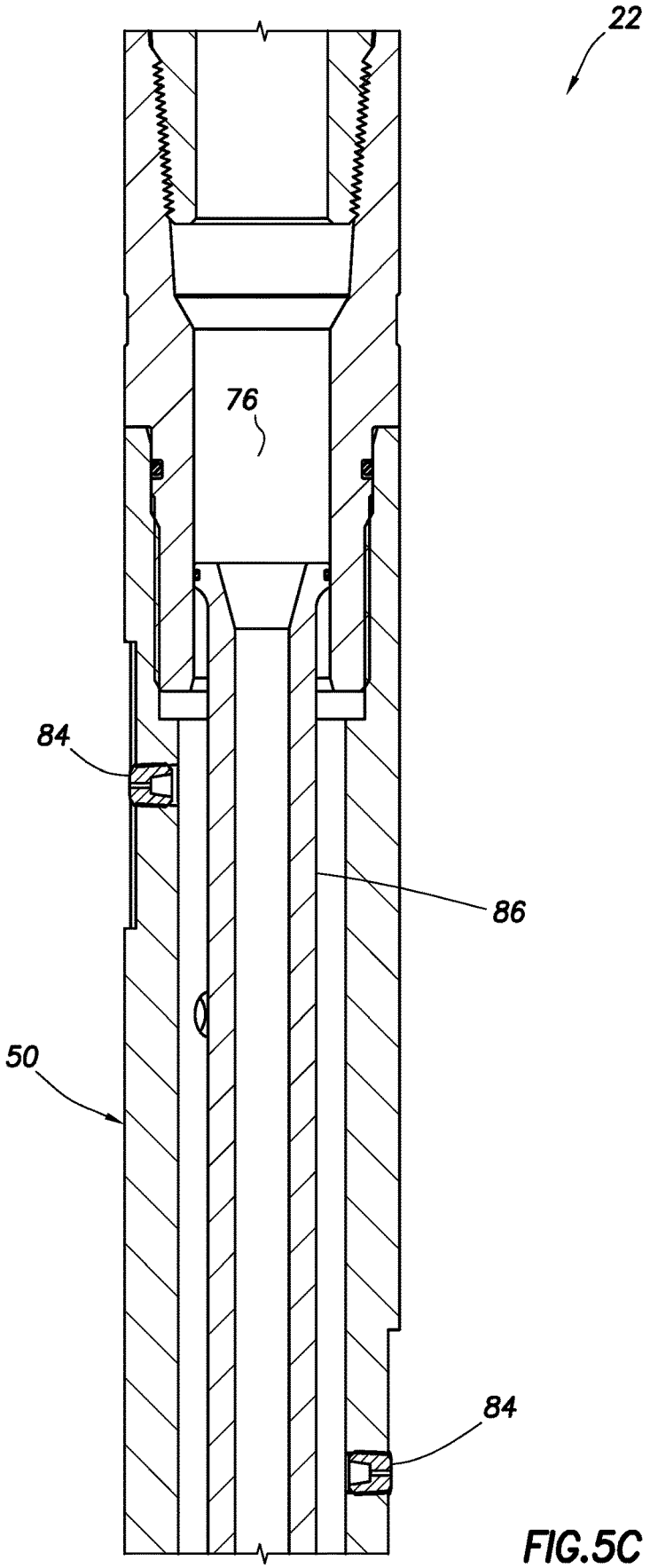
Figure 5D:
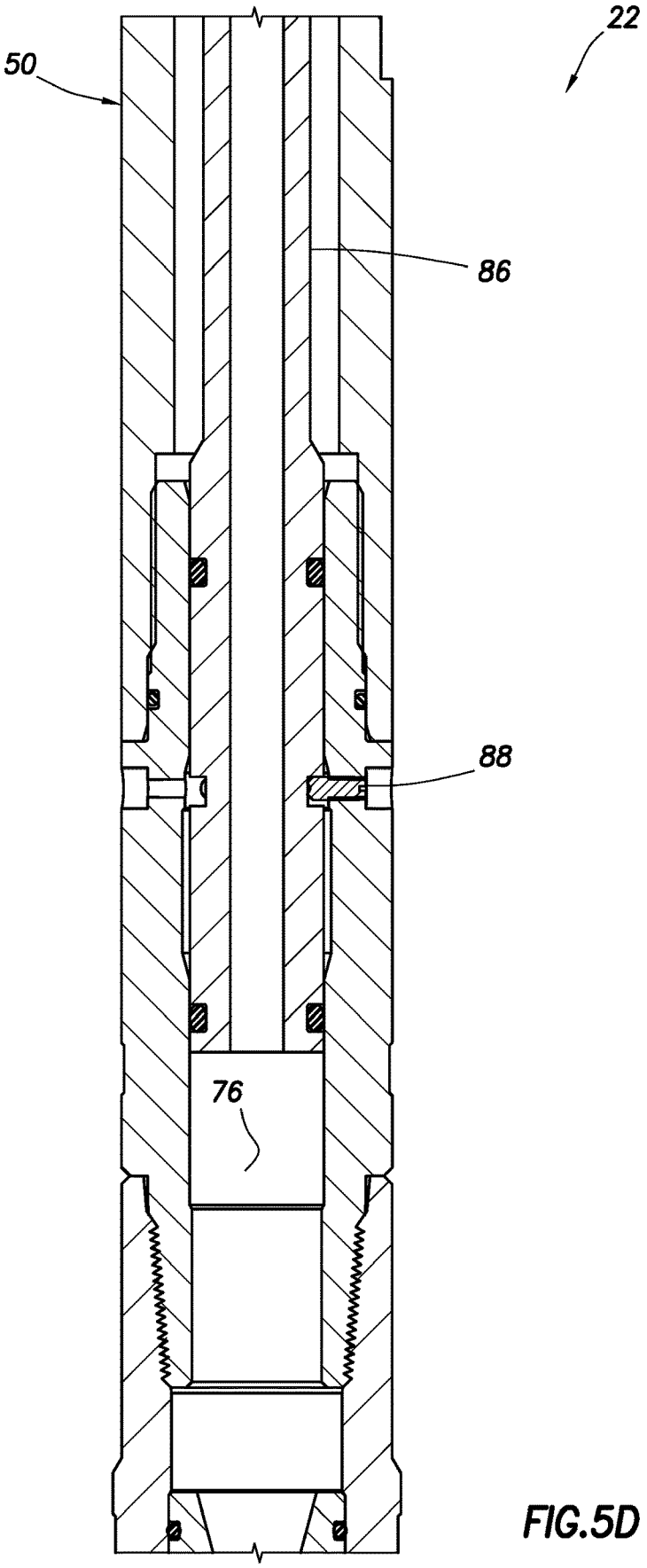

In FIG. 5C, an upper section of the perforator 50 can be seen. Nozzles 84 can be used to accelerate an abrasive fluid flow outward from the perforator 50, in order to form perforations (such as the perforations 54 of FIG. 3).

An inner sleeve 86 initially prevents fluid in the passage 76 from flowing to the nozzles 84, and so the perforator 50 is initially inactive. The sleeve 86 is releasably retained in this position by one or more shear members 88, visible in FIG. 5D.

Figure 5E:
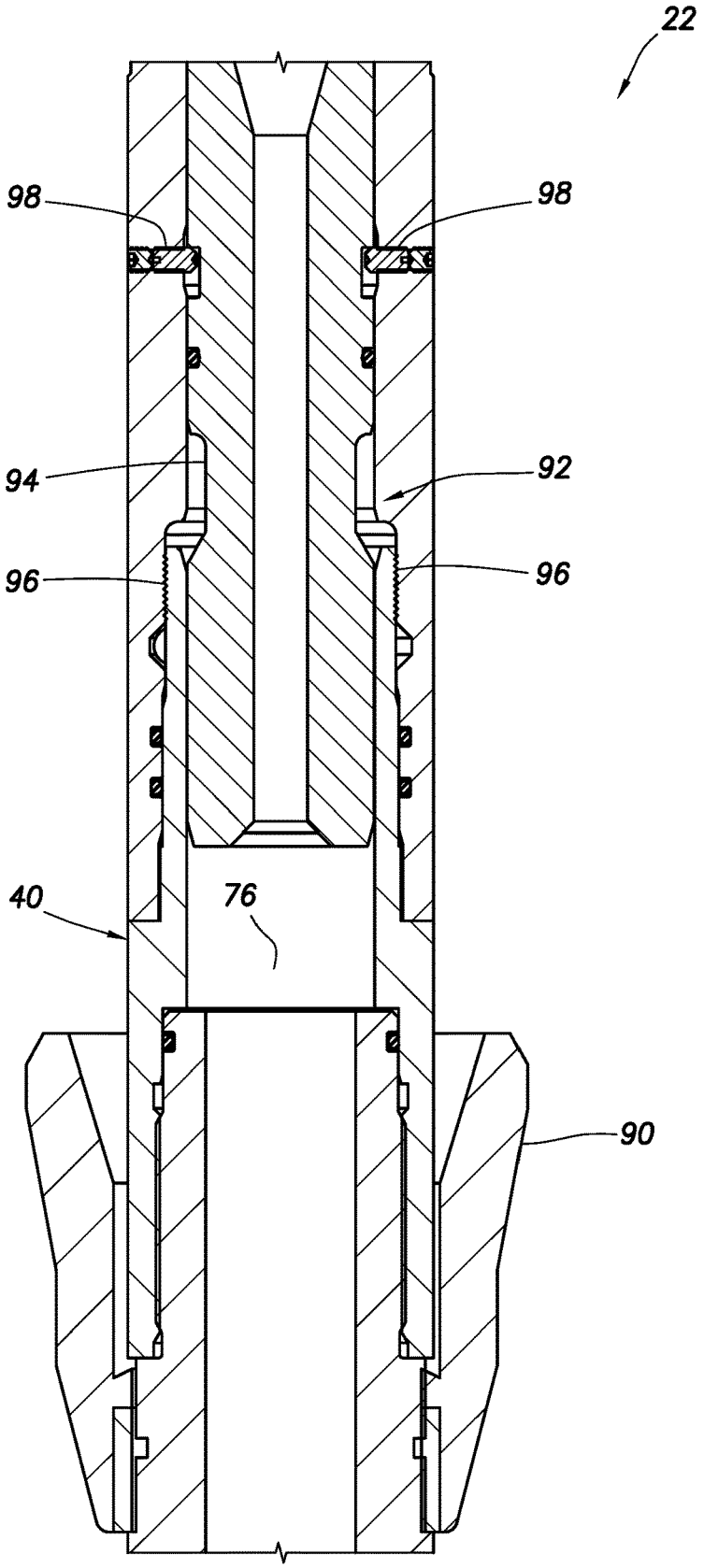

In FIG. 5E, the annular restrictor 40 may be seen. In this example, the annular restrictor 40 includes a resilient (such as, elastomeric) cup packer 90, sometimes referred to as a "swab cup" by those skilled in the art.

The packer 90 is connected below a release mechanism 92. The release mechanism 92 in this example includes an inner support sleeve 94 that initially radially outwardly supports multiple circumferentially distributed threaded collets 96. The support sleeve 94 is releasably retained in this position by shear members 98.

Figure 5F:
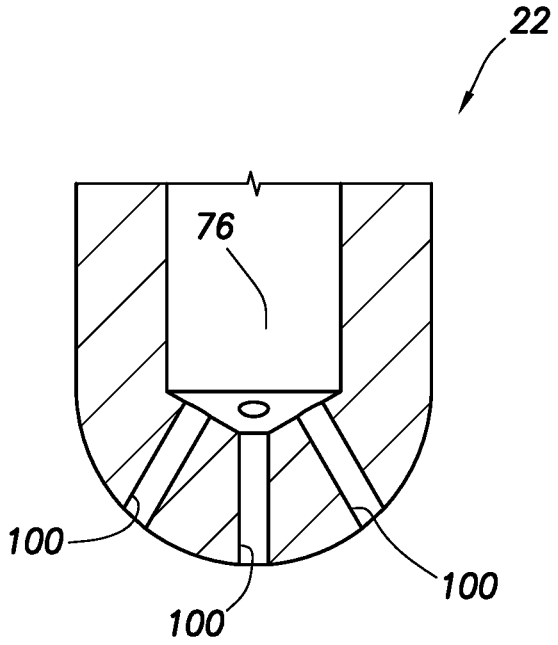

In FIG. 5F, it may be seen that ports 100 are provided through a distal end of the bottom hole assembly 22. The ports 100 allow fluid communication between the flow passage 76 and an exterior of the bottom hole assembly 22 below the annular restrictor 40. In the system 10, the ports 100 will allow the fluid 44 to flow into the passage 76 as the bottom hole assembly 22 advances into the wellbore 14 in response to the pressure differential created across the annular restrictor 40 due to flow of the fluid 42 through the annulus 30.

Figure 6A:
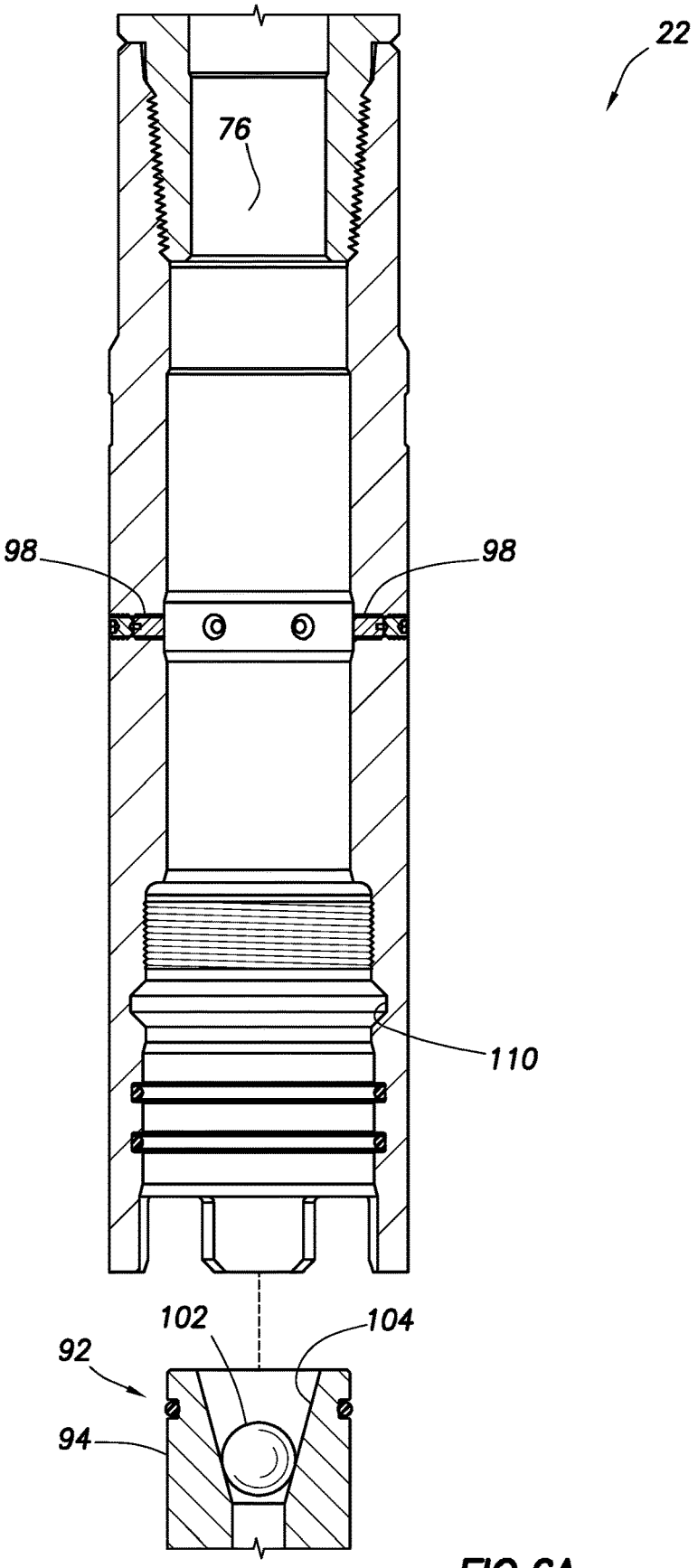
FIGS. 6A & B are representative cross-sectional views of successive axial sections of the bottom hole assembly, depicting release of an annular restrictor from the bottom hole assembly.
Figure 6B:
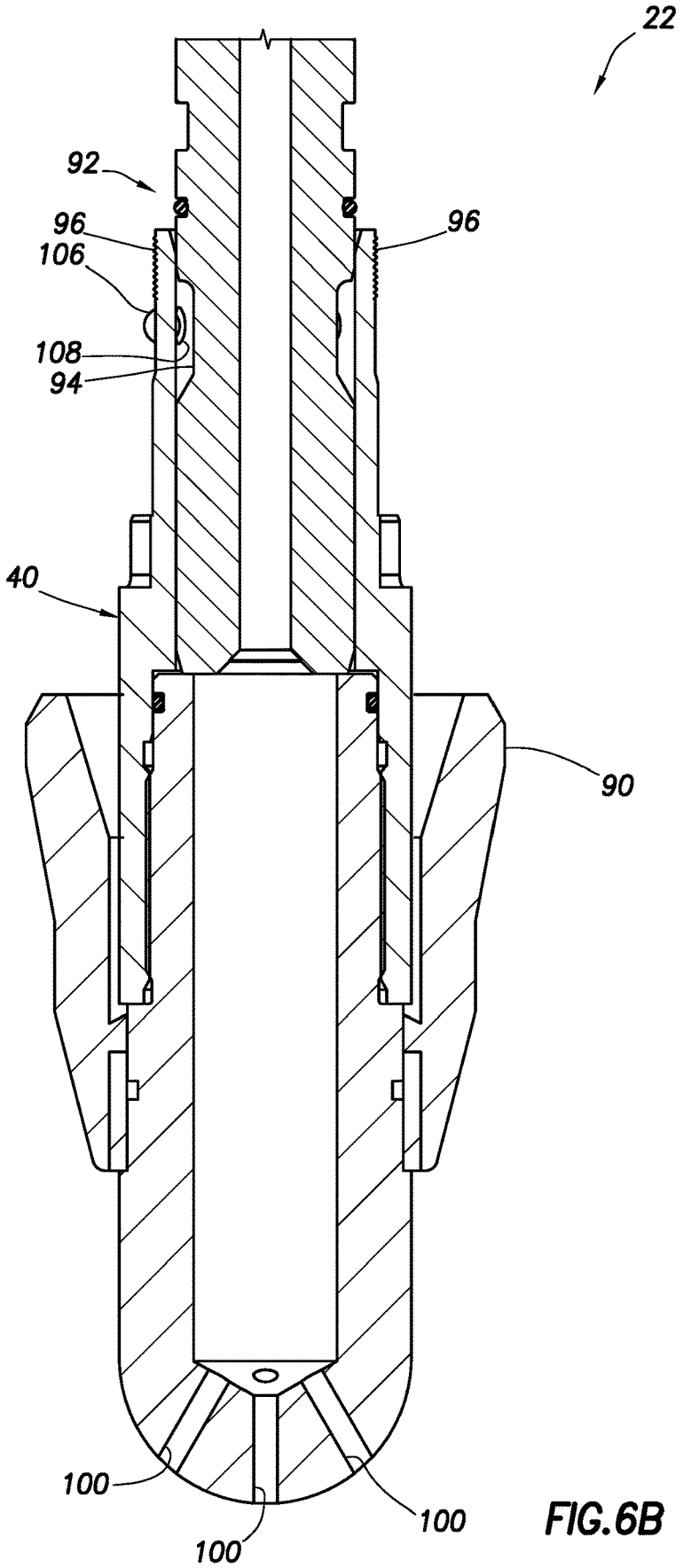

Referring additionally now to FIGS. 6A & B, the annular restrictor 40 is being released from the bottom hole assembly 22. To accomplish this result, a plug 102 (such as a ball or dart, etc.) is sealingly engaged with a tapered seat 104 in the sleeve 94, and increased pressure is applied to the passage 76 above the plug.

For example, the plug 102 could be dropped into the tubular string 12 at the surface, and the pump 36 (see FIG. 1) could be used to displace the plug through the tubular string and into sealing engagement with the seat 104. The pump 36 may also be used to apply increased pressure to the flow passage 76, in order to shear the shear members 98 and displace the sleeve 94 downward, so that it no longer outwardly supports the collets 96.

Instead of the collets 96, balls 106 received in openings 108 could be outwardly supported by the sleeve 94, so that the balls engage an annular recess 110, and so that displacement of the sleeve would allow the balls to disengage from the recess. Thus, the scope of this disclosure is not limited to use of any particular type of release mechanism.

The annular restrictor 40 may be released from the bottom hole assembly 22 after the perforator 50 is appropriately positioned for forming perforations. In other examples, the annular restrictor 40 may be released (or dispersed or otherwise degraded) at any time it is no longer desired to utilize the annular restrictor to displace the bottom hole assembly 22 in response to a pressure differential across the annular restrictor.

Figure 7A:
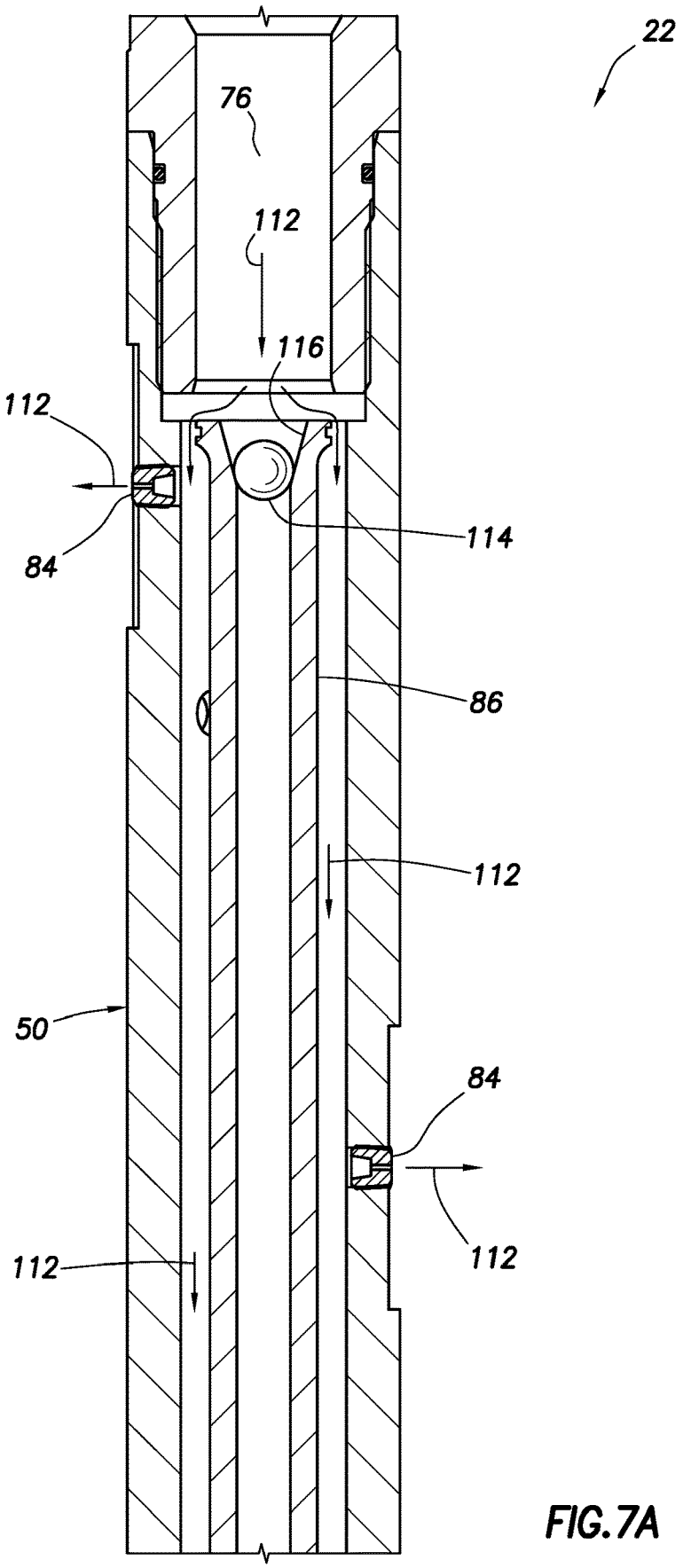
FIGS. 7A & B are representative cross-sectional views of successive axial sections of the bottom hole assembly, depicting activation of an abrasive perforator of the bottom hole assembly.
Figure 7B:
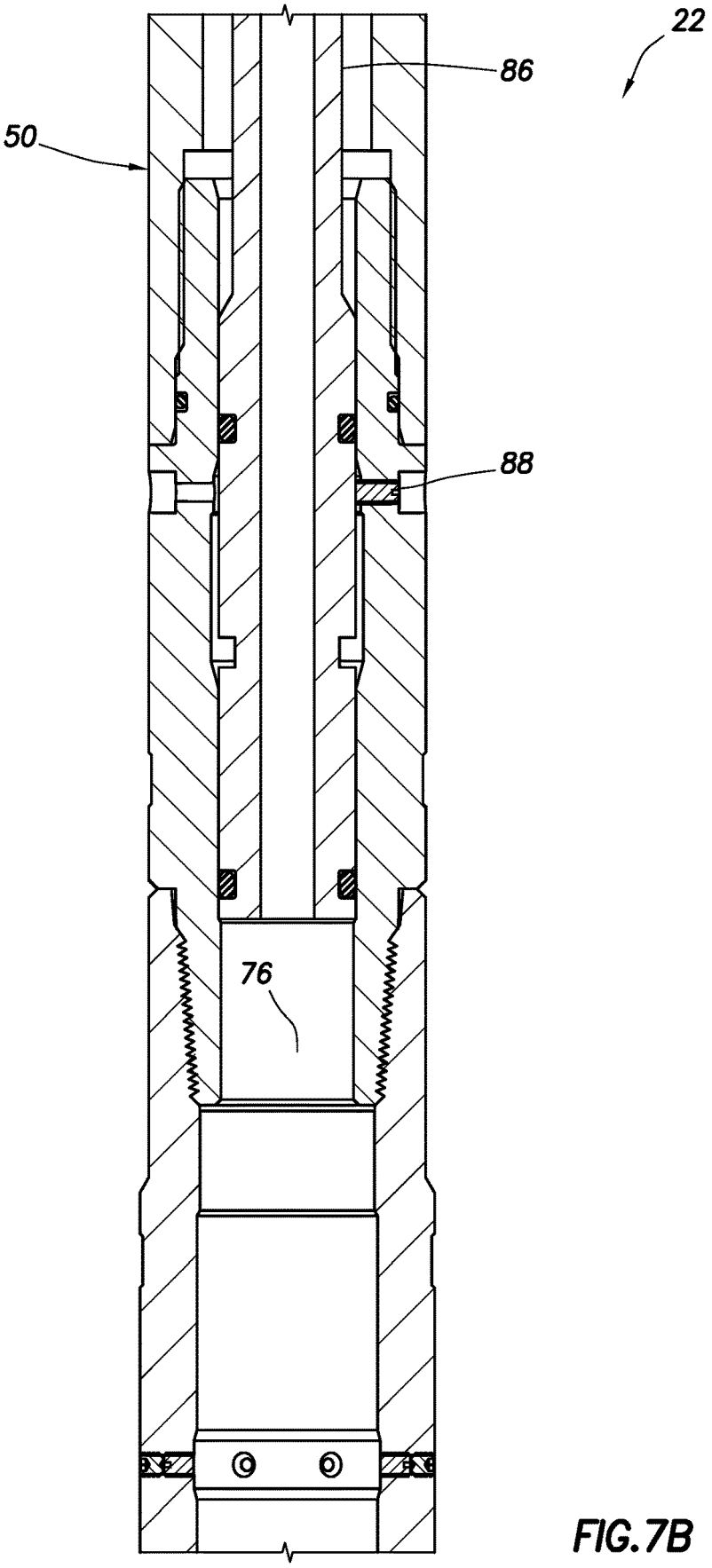

Referring additionally now to FIGS. 7A & B, the bottom hole assembly 22 is representatively illustrated with the perforator 50 activated after the annular restrictor 40 has been released. An abrasive slurry 112 can now be pumped from the surface (for example, using the pump 36), through the flow passage 76, and outward from the nozzles 84.

To accomplish this result, a plug 114 (such as a ball or dart, etc.) is sealingly engaged with a tapered seat 116 in the sleeve 86, and increased pressure is applied to the passage 76 above the plug. The plug 114 can be dimensioned larger than the plug 102 used to release the annular restrictor 40.

For example, the plug 114 could be dropped into the tubular string 12 at the surface, and the pump 36 could be used to displace the plug through the tubular string and into sealing engagement with the seat 116. The pump 36 may also be used to apply increased pressure to the flow passage 76, in order to shear the shear members 88 and displace the sleeve 86 downward.

Figure 8A:
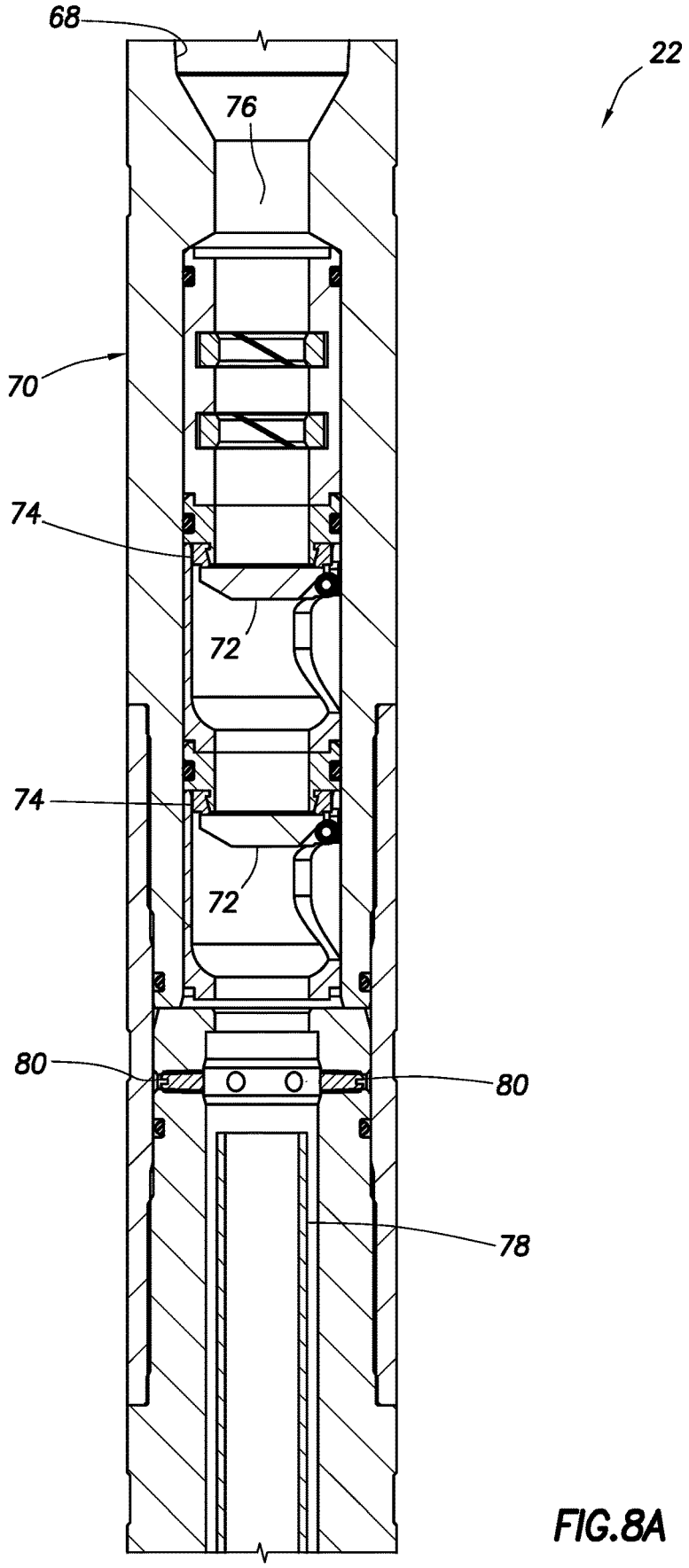
FIGS. 8A & B are representative cross-sectional views of successive axial sections of the bottom hole assembly, depicting activation of a back pressure valve of the bottom hole assembly.
Figure 8B:
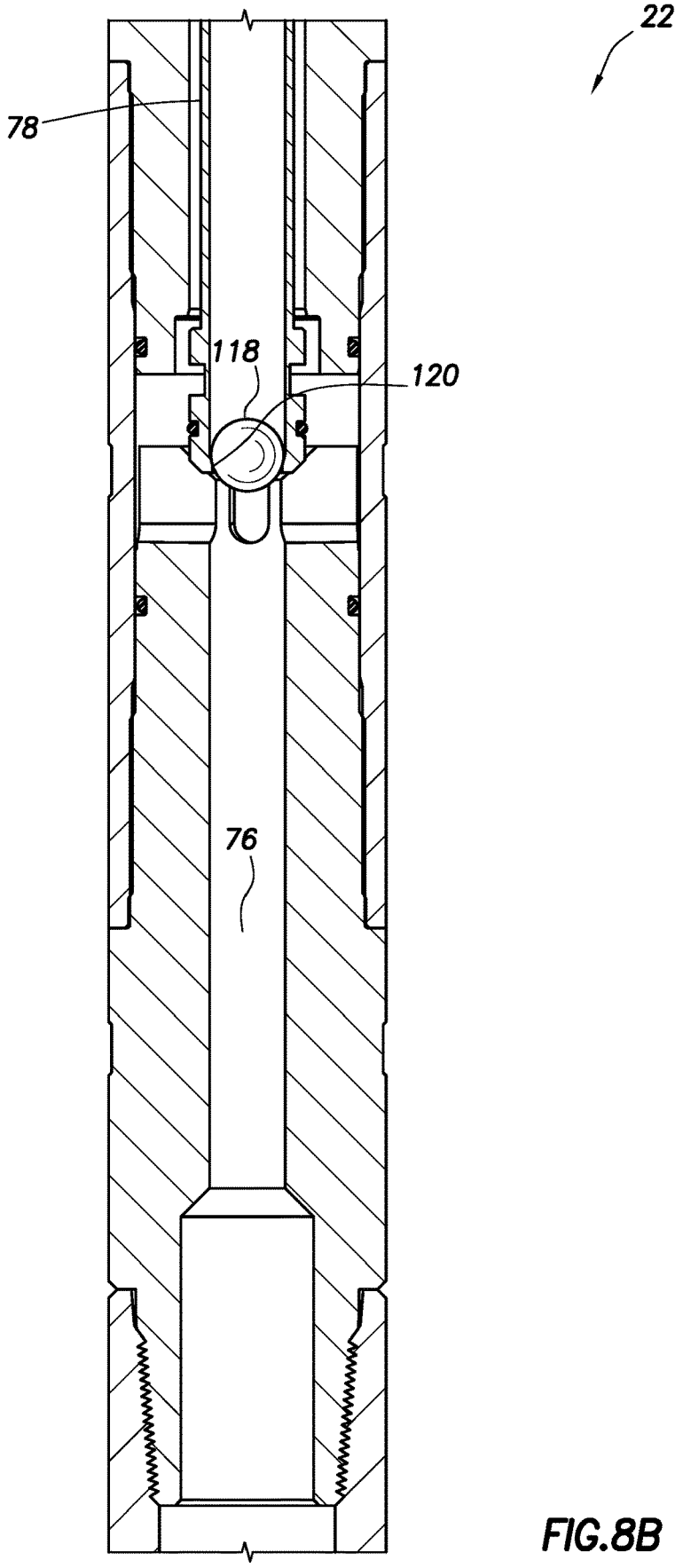

Referring additionally now to FIGS. 8A & B, the bottom hole assembly is representatively illustrated with the back pressure valve 70 activated. The back pressure valve 70 can be activated after perforating operations are concluded, in order to prevent flow of fluids (such as formation hydrocarbons) upward through the tubular string 12.

To activate the back pressure valve 70, a plug 118 (such as a ball or dart, etc.) is sealingly engaged with a tapered seat 120 in the sleeve 78, and increased pressure is applied to the passage 76 above the plug. The plug 118 can be dimensioned larger than the plug 114 used to activate the perforator 50.

For example, the plug 118 could be dropped into the tubular string 12 at the surface, and the pump 36 could be used to displace the plug through the tubular string and into sealing engagement with the seat 120. The pump 36 may also be used to apply increased pressure to the flow passage 76, in order to shear the shear members 80 and displace the sleeve 78 downward.

It may now be fully appreciated that the above disclosure provides significant advancements to the art of conveying tubular strings and bottom hole assemblies into wellbores. In various examples described above, an annular restrictor 40 can be used to displace a tubular string 12 into a wellbore 14, in response to flow of fluid 42 through an annulus 30 and a resulting pressure differential across the annular restrictor.

This disclosure describes tools and methods for advancing well tool assemblies into a wellbore. One concept is to use an annular element on an outside of a bottom hole assembly. The annular element supplies downward force on the bottom hole assembly and tubing when fluid is pumped down an annulus between the tubing and the wellbore.

When fluid is pumped down the annulus, it creates a downward hydraulic force on the element, which tends to advance the bottom hole assembly and tubing into the wellbore. The fluid which is displaced below the annular element by the advancing bottom hole assembly can either flow into an opening in the casing below the bottom hole assembly, or if no openings below the bottom hole assembly exist, the fluid can flow to the surface through the tubing (similar to reverse circulation). The displaced fluid can be fluid displaced below the bottom hole assembly, but separated from the annulus above by the annular element, or it can be a combination of displaced fluid combined with annular flow that passes around or through the annular element.

This method allows large downward forces to be applied to the bottom hole assembly, making it possible to convey tools on flexible tubing strings, such as coiled tubing, to much greater depths than can be achieved by "pushing" tubing into the wellbore from the surface.

Optional configurations include (but are not limited to):

- Abrasive perforating gun deployed with annular element.
- Explosive shaped charge perforating gun deployed with annular element.
- Fluid motor deployed with annular element—
  - The motor can be continuously operated with annular flow to element while displacement fluid flows up through the tubing string.
  - The motor can be continuously operated with annular flow while displacement fluid exits the casing through an opening below the bottom hole assembly.
  - The motor can be operated with flow through the tubing string during cutting, but annular flow can be used to advance the bottom hole assembly into the wellbore when not cutting.
- Fishing bottom hole assembly deployed with annular element.
- Any other bottom hole assembly deployed with annular element.
- Annular element can be disconnected to prevent swabbing on trip out of well.
- A back pressure valve which stays open during deployment to allow flow of displacement fluid through the bottom hole assembly can be utilized. The back pressure valve can be activated by pumping down a plug when back pressure protection is desired (such as, after perforating).

Some specific concepts described above include (but are not limited to):

- Use of annular flow and annular element to "pump down" a bottom hole assembly.
- Use of annular flow and annular element, while returning displacement flow through a tubing string.
- Disconnecting annular element after the bottom hole assembly is advanced into the wellbore (for example, to prevent well swabbing when tubing is withdrawn from the well).
- Perforating a well in which there are no openings in the casing to receive displacement flow.
- Operating and/or advancing a motor with annular flow.
- Advancing any bottom hole assembly or tool with annular flow, with displacement fluid being returned through the tubing string.
- Use of this system and method with single trip multiple zone "perforate, fracture and plug" techniques.

One specific operating method can include the following steps:

1. Pump fluid down annulus to create downward force on an annular element to advance a bottom hole assembly to a location within a well, while either flowing displacement fluid back through tubing string or causing it to exit through a hole in the casing.
2. Disconnect annular element from bottom hole assembly.
3. Activate perforator (either explosive shaped charge or abrasive, etc.) to perforate a zone in the well.
4. Perforate additional locations within the well if desired.
5. Remove bottom hole assembly from the well, or activate reverse flow back pressure valve to eliminate the possibility of reverse flow through tubing string (e.g., for safety purposes).
6. Remove bottom hole assembly from well.

One very useful application of this system and method is to position an abrasive or pyrotechnic (explosive) perforator deep within a wellbore to perforate a "toe" of the well (at or near a distal end of a generally horizontal or substantially inclined wellbore section). In one configuration, an abrasive perforator can be deployed above the annular element. In another configuration, an explosive shaped charge perforator can be deployed below the annular element.

A system 10 for advancing a tubular string 12 into a wellbore 14 can include an annular restrictor 40 connected in the tubular string. The annular restrictor 40 restricts flow through an annulus 30 formed between the tubular string 12 and the wellbore 14. Restriction to the flow through the annulus 30 biases the tubular string 12 into the wellbore 14, and fluid in the wellbore displaces into at least one of: a) a formation 56 penetrated by the wellbore and b) the tubular string.

The annular restrictor 40 may be connected at a distal end of the tubular string 12 in the wellbore 14. The annular restrictor 40 may permit restricted flow past the annular restrictor.

The system 10 may include a vibratory tool 48 that generates vibrations in response to displacement of the fluid 44 in the wellbore 14 into the tubular string 12.

The annular restrictor 40 may be connected between a perforator 50 and a tubing 20 extending to surface (e.g., at or near the earth's surface, as depicted in FIG. 1). The system 10 may include a ported sub 58 connected between the annular restrictor 40 and the perforator 50. The ported sub 58 can permit the fluid 44 in the wellbore 14 to displace into the tubular string 12.

A perforator 50 may be connected between the annular restrictor 40 and a tubing 20 extending to surface.

The annular restrictor 40 may be connected between a fluid motor 60 and a tubing 20. The system 10 may include a ported sub 66 connected between the annular restrictor 40 and the fluid motor 60. The ported sub 66 can permit the fluid 42 in the wellbore 14 to displace into the tubular string 12 and flow through the fluid motor 60.

The system of claim 1, further comprising a release mechanism that releases the annular restrictor from the tubular string.

A method of advancing a tubular string 12 into a wellbore 14 can include connecting an annular restrictor 40 in the tubular string 12, and flowing a first fluid 42 through an annulus 30 formed between the tubular string 12 and the wellbore 14, thereby causing a differential pressure across the annular restrictor 40, the differential pressure biasing the tubular string 12 into the wellbore 14.

The method may include flowing a second fluid 44 from the wellbore 14 into the tubular string 12 as the tubular string advances into the wellbore. At least a portion of the first fluid 42 may flow with the second fluid 44 into the tubular string 12. The step of flowing the second fluid may include generating vibrations in response to the second fluid 44 flowing from the wellbore 14 into the tubular string 12.

The method may include flowing a second fluid 44 from the wellbore 14 into a formation 56 penetrated by the wellbore as the tubular string 12 advances into the wellbore.

The method may include rotating a cutting device 62 in response to the first fluid 42 flowing from the wellbore 14 into the tubular string 12. The method may also include releasing the annular restrictor 40 from the tubular string 12 after the cutting device 62 rotating step.

The method may include, after the flowing step, perforating a casing 16 that lines the wellbore 14. The method may also include releasing the annular restrictor 40 from the tubular string 12 prior to the perforating step.

The method may include degrading the annular restrictor 40 in the wellbore 14 prior to retrieving the tubular string 12 from the wellbore.

Another method of advancing a tubular string 12 into a wellbore 14 can include connecting an annular restrictor 40 in the tubular string 12, flowing a fluid 42 through an annulus 30 formed between the tubular string 12 and the wellbore 14, thereby biasing the tubular string 12 into the wellbore 14, and then causing the annular restrictor 40 to cease restricting flow through the annulus 30.

The causing step may be performed prior to retrieving the tubular string 12 from the wellbore 14.

The causing step may be performed by releasing the annular restrictor 40 from the tubular string 12.

The causing step may be performed by at least one of: dissolving the annular restrictor 40, degrading the annular restrictor 40 and dispersing the annular restrictor 40.

The causing step may be performed prior to, or after, perforating a casing 16 that lines the wellbore 14.

The causing step may be performed after rotating a cutting device 62 in response to the fluid 42 flowing step.

The causing step may be performed prior to rotating a cutting device 62 in the wellbore 14.

The method may include closing a back pressure valve 70 after the causing step.

The method may include permitting flow from the wellbore 14 into the tubular string 12 as the tubular string advances into the wellbore.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. In general, the term "above" is used to indicate a direction toward the earth's surface along a wellbore, and the term "below" is used to indicate a direction away from the earth's surface along a wellbore. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for advancing a tubular string into a wellbore, the system comprising:

an annular restrictor connected in the tubular string, wherein the annular restrictor is connected between a perforator and a tubing extending to surface, and wherein the annular restrictor restricts flow through an annulus formed between the tubular string and the wellbore, wherein restriction to the flow through the annulus biases the tubular string into the wellbore, and wherein fluid in the wellbore displaces into at least one of the group consisting of: a) a formation penetrated by the wellbore and b) the tubular string.

2. The system of claim 1, wherein the annular restrictor is connected at a distal end of the tubular string in the wellbore.

3. The system of claim 1, wherein the annular restrictor permits restricted flow past the annular restrictor.

4. The system of claim 1, further comprising a vibratory tool that generates vibrations in response to displacement of the fluid in the wellbore into the tubular string.

5. The system of claim 1, further comprising a ported sub connected between the annular restrictor and the perforator, and wherein the ported sub permits the fluid in the wellbore to displace into the tubular string.

6. The system of claim 1, further comprising a release mechanism that releases the annular restrictor from the tubular string.

7. A method of advancing a tubular string into a wellbore, the method comprising:

connecting an annular restrictor in the tubular string;

flowing a first fluid through an annulus formed between the tubular string and the wellbore, thereby causing a differential pressure across the annular restrictor, the differential pressure biasing the tubular string into the wellbore; and degrading the annular restrictor in the wellbore prior to retrieving the tubular string from the wellbore.

8. The method of claim 7, further comprising flowing a second fluid from the wellbore into the tubular string as the tubular string advances into the wellbore.

9. The method of claim 8, wherein at least a portion of the first fluid flows with the second fluid into the tubular string.

10. The method of claim 8, wherein the second fluid flowing further comprises generating vibrations in response to the second fluid flowing from the wellbore into the tubular string.

11. The method of claim 7, further comprising flowing a second fluid from the wellbore into a formation penetrated by the wellbore as the tubular string advances into the wellbore.

12. The method of claim 7, further comprising rotating a cutting device in response to the first fluid flowing from the wellbore into the tubular string.

13. The method of claim 7, further comprising, after the flowing, perforating a casing that lines the wellbore.

14. A method of advancing a tubular string into a wellbore, the method comprising:

connecting an annular restrictor in the tubular string;

flowing a fluid through an annulus formed between the tubular string and the wellbore, thereby biasing the tubular string into the wellbore; and then causing the annular restrictor to cease restricting flow through the annulus, wherein the causing is performed by at least one of the group consisting of: dissolving the annular restrictor, degrading the annular restrictor and chemically dispersing the annular restrictor.

15. The method of claim 14, wherein the causing is performed prior to retrieving the tubular string from the wellbore.

16. The method of claim 14, wherein the causing is performed prior to perforating a casing that lines the wellbore.

17. The method of claim 14, wherein the causing is performed after perforating a casing that lines the wellbore.

18. The method of claim 14, wherein the causing is performed after rotating a cutting device in response to the fluid flowing.

19. The method of claim 14, wherein the causing is performed prior to rotating a cutting device in the wellbore.

20. The method of claim 14, further comprising closing a back pressure valve after the causing.

21. The method of claim 14, further comprising permitting flow from the wellbore into the tubular string as the tubular string advances into the wellbore.

* * * * *